US008714683B2

(12) United States Patent
Kato

(10) Patent No.: US 8,714,683 B2
(45) Date of Patent: May 6, 2014

(54) IMAGE RECORDING APPARATUS AND IMAGE RECORDING METHOD INCLUDING A HUMIDIFYING UNIT

(75) Inventor: Shigeki Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 228 days.

(21) Appl. No.: 13/305,643

(22) Filed: Nov. 28, 2011

(65) Prior Publication Data

US 2012/0133698 A1 May 31, 2012

(30) Foreign Application Priority Data

Nov. 30, 2010 (JP) ..... 2010-267209

(51) Int. Cl.
*B41J 29/38* (2006.01)

(52) U.S. Cl.
USPC ..... 347/16; 347/101; 347/104

(58) Field of Classification Search
USPC ..... 347/16, 20, 22, 25, 26, 101–105
See application file for complete search history.

(56) References Cited

U.S. PATENT DOCUMENTS 8,342,678 B2 * 1/2013 Kawakami et al. ..... 347/105

FOREIGN PATENT DOCUMENTS

JP 2010-125830 6/2010

* cited by examiner

*Primary Examiner* — Juanita D Jackson
(74) *Attorney, Agent, or Firm* — Workman Nydegger

(57) ABSTRACT

An image recording apparatus includes: a transport unit that transports, along a transport path, a medium having a recording base material whose one surface is a recording layer for an image and whose other surface is an adhesive layer and a separating base material that covers the adhesive layer; a recording unit that records an image onto the medium; a heating unit that fixes the recorded image onto the medium; and a humidifying unit that humidifies the medium.

7 Claims, 4 Drawing Sheets

IMAGE RECORDING APPARATUS AND IMAGE RECORDING METHOD INCLUDING A HUMIDIFYING UNIT

This application claims the benefit of Japanese Patent Application No. 2010-267209, filed on Nov. 30, 2010, which is hereby incorporated by reference herein in its entirety.

BACKGROUND

1. Technical Field

The present invention relates to image recording apparatuses and image recording methods.

2. Related Art

Printers that print images by ejecting ink from a head onto a medium such as paper exist as examples of image recording apparatuses. Furthermore, among such printers, there are printers that have drying units (heating units) that fix the printed images onto the medium by heating the medium onto which the images have been printed (for example, JP-A-2010-125830).

There are cases where images are printed onto a sticker sheet, in which recording paper (a recording base material) that has an adhesive layer on the opposite side as the printed surface and a separator (a separating base material) that covers the adhesive layer are formed as an integral sheet. Normally, when the moisture evaporates from the adhesive layer of a sticker sheet and the adhesive layer dries, the adhesive strength of the adhesive layer drops. Accordingly, when sticker sheets are used in a printer, whose main unit reaches a comparatively high temperature inside due to the drying unit, there is a risk that the moisture will evaporate from the adhesive layer of the sticker sheets, thus causing the recording paper and the separator to separate from each other.

SUMMARY

It is an advantage of some aspects of the invention to prevent a recording base material and a separating base material from separating.

According to an aspect of the invention, an image recording apparatus includes: a transport unit that transports, along a transport path, a medium having a recording base material whose one surface is a recording layer for an image and whose other surface is an adhesive layer and a separating base material that covers the adhesive layer; a recording unit that records an image onto the medium; a heating unit that fixes the recorded image onto the medium; and a humidifying unit that humidifies the medium.

According to this image recording apparatus, the recording base material and the separating base material can be prevented from separating from each other.

In the image recording apparatus, it is preferable that the transport unit transport the medium using a plurality of transport rollers; and the humidifying unit humidify the portion of the medium that is stretched upon one of two of the transport rollers that are provided sequentially in the transport path and that make contact with different surfaces of the medium.

According to this image recording apparatus, the recording base material and the separating base material can be prevented from separating from each other in situations where it is easy for the recording base material and the separating base material to separate from each other.

In the image recording apparatus, it is preferable that the humidifying unit humidify the portion of the medium that is stretched upon the second transport roller from the upstream side in the transport path among three of the transport rollers that are provided sequentially in the transport path and that make contact with different surfaces of the medium in an alternating manner.

According to this image recording apparatus, the recording base material and the separating base material can be prevented from separating from each other equally regardless of which transport roller the portion of the medium is stretched upon.

In the image recording apparatus, it is preferable that the humidifying unit humidify the medium from the separating base material side.

According to this image recording apparatus, it is possible to prevent the recording base material from being excessively humidified.

In the image recording apparatus, it is preferable that the humidifying unit produce water vapor by heating water and humidify the medium using the water vapor; and the same heat source is used as a heat source for the heating unit and a heat source used by the humidifying unit to heat the water.

According to this image recording apparatus, it is possible to achieve a reduction in costs, a reduction in consumed energy, and so on.

In the image recording apparatus, it is preferable that the humidifying unit humidify the medium in the case where a predetermined amount of time has passed after the transport unit has stopped transporting the medium.

According to this image recording apparatus, it is possible to prevent the recording base material from being excessively humidified while also preventing the recording base material and the separating base material from separating from each other.

In addition, an image recording method is a method for recording an image onto a medium using an image recording apparatus, the apparatus including: a transport unit that transports, along a transport path, a medium having a recording base material whose one surface is a recording layer for an image and whose other surface is an adhesive layer and a separating base material that covers the adhesive layer; a recording unit that records an image onto the medium; a heating unit that fixes the recorded image onto the medium; and a humidifying unit that humidifies the medium.

According to this image recording method, it is possible to record an image in a state in which the recording base material and the separating base material are prevented from separating from each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

The descriptions in this specification and the appended drawings will make clear at least the following points.

Printer

Hereinafter, an embodiment will be described using an ink jet printer (called a "printer" hereinafter) as an example of an image recording apparatus.

Figure 1:
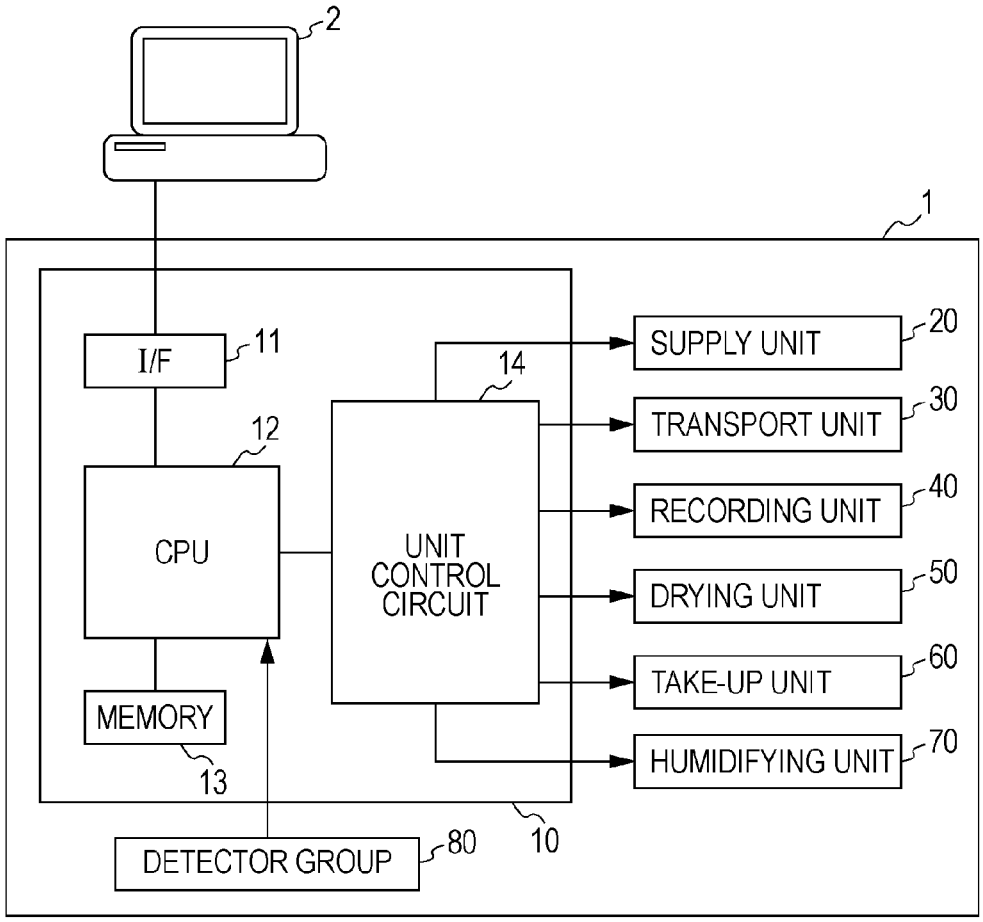
FIG. 1 is a block diagram illustrating the overall configuration of a printer.
Figure 2:
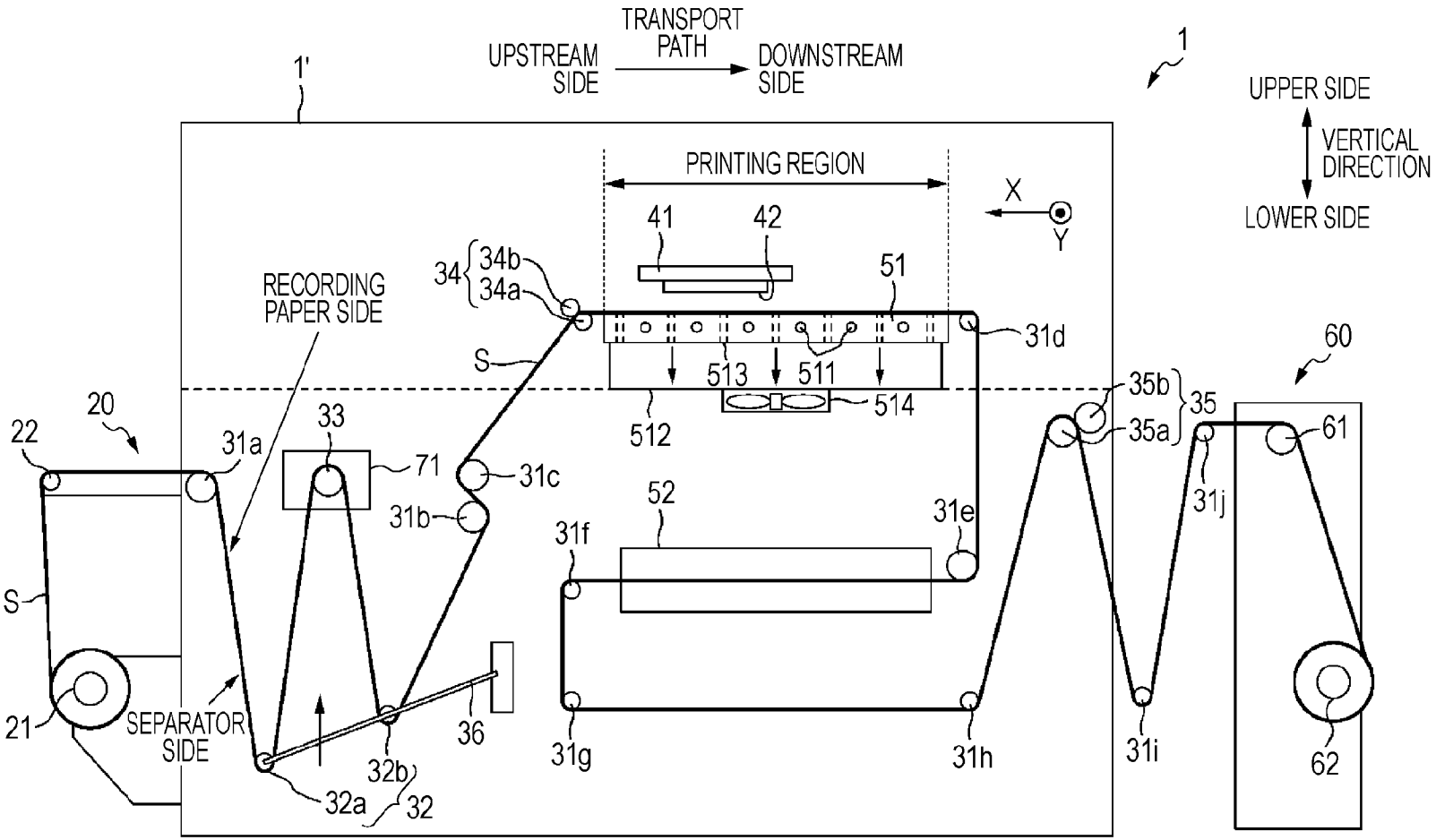
FIG. 2 is a cross-sectional view generally illustrating the printer.

FIG. 1 is a block diagram illustrating the overall configuration of a printer 1. FIG. 2 is a cross-sectional view generally illustrating the printer 1. The printer 1 according to this embodiment prints images onto roll paper S (a continuous sheet) serving as a medium. The printer 1 is communicably connected to a computer 2, and the computer 2 generates print data for causing the printer 1 to print images. Note that the functions of the computer 2 may be implemented within the printer 1.

A controller 10 is a control unit for controlling the printer 1. An interface unit 11 is a unit used for exchanging data between the computer 2 and the printer 1. A CPU 12 is a computational processing device for carrying out the overall control of the printer 1. A memory 13 is a unit for securing a region for storing programs executed by the CPU 12, a work region, and so on. The CPU 12 controls the various units in accordance with a unit control circuit 14. Note that a detector group 80 monitors conditions within the printer 1, and the controller 10 controls the various units based on detection results from the detector group 80.

A supply unit 20 supplies the roll paper S to a transport unit 30. The supply unit 20 includes a winding shaft 21, upon which the roll paper S is wound and supported in a rotatable state, and an intermediate roller 22, for taking up the roll paper S that has been let out from the winding shaft 21 and leading that roll paper S to the transport unit 30. Note that the supply unit 20 is located outside of a main unit 1' of the printer 1.

The transport unit 30 (this corresponds to a "transport unit") transports the roll paper S along a pre-set transport path using a plurality of transport rollers. The transport unit 30 includes a plurality of intermediate rollers 31*a* to 31*j*, mobile rollers 32, a fixed roller 33, supply rollers 34, and discharge rollers 35. The mobile rollers 32 and the fixed roller 33 are provided between the supply unit 20 and a printing region, the supply rollers 34 are provided immediately upstream from the printing region, and the discharge rollers 35 are provided downstream from the printing region. The roll paper S sequentially moves along these transport rollers, and thus a transport path for transporting the roll paper S is formed.

The supply rollers 34 and the discharge rollers 35 are each configured of a pair of rollers; one roller in each of these pairs is a driving roller (34*a*, 35*a*) that is rotated by a motor (not shown), whereas the other roller in each of these pairs is a slave roller (34*b*, 35*b*) that rotates along with its corresponding driving roller. When the printing of images onto the roll paper S located in the printing region is complete, the supply rollers 34, the discharge rollers 35, and so on rotate, discharging the portion of the roll paper S onto which the images have been printed from the printing region and supplying, to the printing region, a new portion of the roll paper S onto which images have not yet been printed. In other words, printing operations carried out on the roll paper S positioned in the printing region and transport operations for the roll paper S are repeated in an alternating manner.

The mobile rollers 32 are configured of a first mobile roller 32*a* and a second mobile roller 32*b*. A pair of arms 36 are attached to both ends of the respective rotating shafts of the first mobile roller 32*a* and the second mobile roller 32*b* so that those rollers are capable of rotating. The arms 36 move in the vertical direction of the printer 1. Accordingly, the first mobile roller 32*a* and the second mobile roller 32*b* also move in the vertical direction along with the arms 36. On the other hand, the fixed roller 33 is fixed at a predetermined position in the vertical direction of the printer 1.

As the result of a single transport operation, an amount of the roll paper S that corresponds to the length of the printing region in the X direction is transported at a predetermined speed. However, there are cases where the roll paper S cannot be let out fast enough from the supply unit 20 (the winding shaft 21), such as when the roll paper S has just been replaced and is therefore heavy. Accordingly, the amount of the roll paper S that is transported in a single transport operation is stretched upon the mobile rollers 32 and the fixed roller 33, and some slack is provided therein. By doing so, in the case where there has been delay when the roll paper S is let out from the supply unit 20 during the transport operation, the mobile rollers 32 and the arms 36 are raised, and the slackened portion of the roll paper S is then transported. As a result, it is possible to supply a predetermined length of the roll paper S to the printing region in a predetermined transport time.

A recording unit 40 (this corresponds to a "recording unit") is a unit that prints (records) images onto the roll paper S that is positioned at the printing region, and includes a carriage 41 and a head 42. The carriage 41 moves the head 42 in the X direction (that is, the direction in which the roll paper S is transported) and the Y direction (that is, the width direction of the roll paper S) while being guided by a guide shaft (not shown). The head 42 is a unit that ejects ink onto the roll paper S, and a plurality of nozzles, serving as ink ejection units, are provided in the bottom surface of the head 42. Two-dimensional images are printed onto the roll paper S by the head 42 ejecting ink while moving in the X direction and the Y direction along with the carriage 41.

Note that the roll paper S that is positioned at the printing region is supported from its rear surface, which is on the opposite side of the printing surface, by the upper surface of a platen 51. Meanwhile, the technique for ejecting ink through the nozzles may be a piezoelectric technique that ejects the ink by applying a voltage to a driving element (a piezoelectric element) and causing a pressure chamber to expand and shrink, or may be a thermal technique that uses a thermal element to produce bubbles within the nozzles and ejects the ink using the bubbles.

A drying unit 50 (this corresponds to a "heating unit") is a unit for fixing the images that have been printed onto the roll paper S. In other words, the drying unit 50 is a unit for drying the ink that has landed on the roll paper S, and includes the platen 51 and a drying chamber 52.

A plurality of heaters 511 (for example, nichrome wires) is disposed within the platen 51. When the heaters 511 are electrified, the temperature of the platen 51 rises, and the temperature of the roll paper S upon the platen 51 therefore also rises. As a result, it is possible to accelerate the drying of the ink that has landed on the roll paper S upon the platen 51, and is thus possible to suppress the ink in the printed images from bleeding. Note that the heaters 511 are disposed throughout the entire region of the platen 51 so that the heat is conducted to the roll paper S upon the platen 51 in a uniform manner.

In addition, suction holes 513 are provided in the platen 51, and a pressure chamber 512 and a fan 514 (an axial fan) are provided below the platen 51. When the air within the pressure chamber 512 is sucked out by the fan 514, a negative pressure is produced within the pressure chamber 512, and suction is therefore applied to the roll paper S upon the platen 51 through the suction holes 513. As a result, the roll paper S upon the platen 51 is sucked and held onto the upper surface of the platen 51. Doing so makes it possible to keep the roll paper S upon the platen 51 in a predetermined position, and ensure that the ink droplets land in their proper positions. Furthermore, this makes it possible to keep the roll paper S level and flat even if the roll paper S is wed and expanded due to the moisture of the ink droplets. However, this is not limited to suction, and the roll paper S may instead be held down using, for example, electrostatic attraction.

The drying chamber 52 is provided downstream from the printing region in the transport path, and the air within the drying chamber 52 is at a high temperature. Accordingly, the images that have been printed onto the roll paper S that has been supplied into the drying chamber 52 can be fixed on to the roll paper S. As a result, even if the printed roll paper S is once again wound up, it is possible to prevent the rear surface of the roll paper S from being soiled by ink, and is thus possible to provide high-quality printed materials.

A take-up unit 60 is a unit for taking up the roll paper S that has come from the transport unit 30 (that is, the printed roll paper S). The take-up unit 60 includes an intermediate roller 61 that winds and transports the roll paper S that has come from the intermediate roller 31*j*, and a take-up driving shaft 62 that takes up the roll paper S. Note that the take-up unit 60 is located outside of the main unit 1' of the printer 1.

A humidifying unit 70 (this corresponds to a "humidifying unit") is a unit for humidifying the roll paper S. In other words, the humidifying unit 70 is a unit for increasing the moisture content of the roll paper S. With the printer 1 according to this embodiment, the portion of the roll paper S that is stretched upon the fixed roller 33 is surrounded by a humidifying partition 71 and is humidified (details of this will be given later).

Separation Phenomenon

Figure 3A:
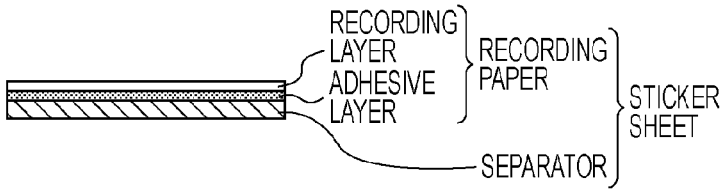
FIG. 3A and FIG. 3B are diagrams illustrating a medium.
Figure 3B:
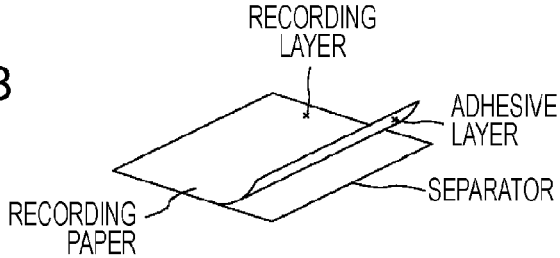
Figure 4:
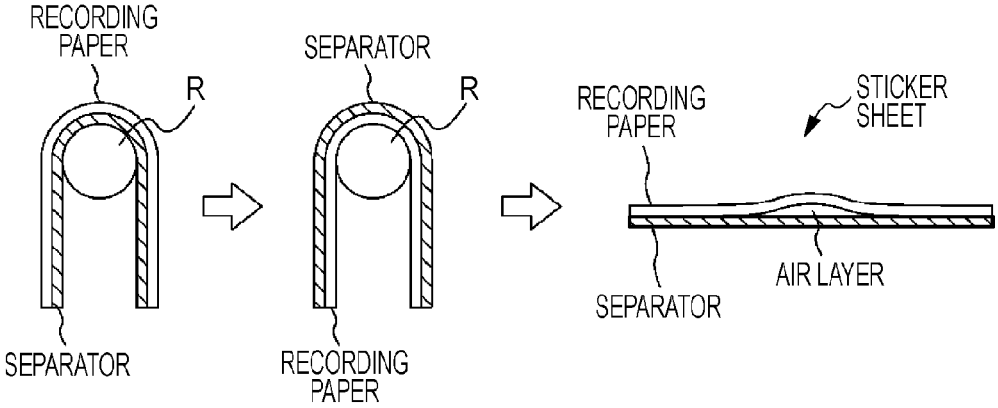
FIG. 4 is a diagram illustrating a separation phenomenon.

FIGS. 3A and 3B are diagrams illustrating the medium used in this embodiment (that is, the aforementioned roll paper S), and FIG. 4 is a diagram illustrating a separation phenomenon. In this embodiment, a sticker sheet is used as the medium onto which images are recorded, and the sticker sheet includes recording paper (this corresponds to a "recording base material") whose one surface is a recording layer for the images and whose other surface is an adhesive layer, and a separator (this corresponds to a "separating base material") that covers the adhesive layer of the recording paper. As shown in FIG. 3B, the recording paper and the separator can be separated from each other. Note that the recording paper is not limited to paper, and may instead be a film or the like. With the printer 1 illustrated in FIG. 2, the sticker sheet is set so that the recording paper (the recording layer) faces the head 42 and the separator makes contact with the platen 51.

As mentioned earlier, the high-temperature platen (for example, 45° C.) and the drying chamber 52 (for example, 75° C.) are provided within the main unit 1' of the printer 1 in order to fix the images that have been printed onto the sticker sheet. Due to the platen 51 and the drying chamber 52, the interior of the main unit 1' of the printer 1 is at a comparatively high temperature, and is also comparatively dry (for example, the temperature is 40° C. and the humidity is 30%).

Accordingly, there is a risk that while the sticker sheet is present within the high-temperature main unit 1', the moisture will evaporate from the sticker sheet and the sticker sheet will dry out as a result. Normally, if the moisture evaporates from the adhesive of which the adhesive layer of the sticker sheet is configured (that is, the adhesive that has been applied to the recording paper) and the adhesive material dries out, the adhesive strength of the adhesive will drop. If this happens, there is a risk that an air layer will be produced between the recording paper and the separator, and the recording paper and the separator will partially separate from each other (this phenomenon is referred to as a "separation phenomenon" hereinafter).

A large amount of moisture evaporates from the sticker sheet and the separation phenomenon is likely to occur particularly when the sticker sheet is present within the high-temperature main unit 1' for a long period of time, such as when printing is stopped for a long period of time (for example, one hour or more) for maintenance purposes or the like with the platen 51, the drying chamber 52, and so on still being heated.

Meanwhile, with the printer 1 according to this embodiment (see FIG. 2), the sticker sheet is transported within the main unit 1' while being stretched upon a plurality of transport rollers. During the period when the sticker sheet is not being transported, such as when printing operations or maintenance operations are being carried out, the same portions of the sticker sheet continue to be stretched upon the transport rollers within the high-temperature main unit 1'. In other words, moisture evaporates from the sticker sheet while the same portions of the sticker sheet are stretched upon the transport rollers. Normally, the recording paper, the separator, and so on will harden if moisture evaporates from the recording paper, the separator, and so on and the recording paper, the separator, and so on dry out as a result. Accordingly, if moisture evaporates from the sticker sheet while the same portions of the sticker sheet are stretched upon the transport rollers, not only will the adhesive strength of the adhesive layer drop, but curls will also be formed in the sticker sheet by the transport rollers. This makes the separation phenomenon even more likely to occur.

For example, if the sticker sheet continues to be stretched upon a transport roller R within the high-temperature main unit 1' in a manner in which the separator and the transport roller R make contact with each other, as illustrated in the left side of FIG. 4, a curl is formed in the sticker sheet so that the inner side of the separator curves, and the adhesive strength of the adhesive layer also drops. If the sticker sheet is then stretched upon a transport roller R so that the recording paper and the transport roller R make contact with each other and the sticker sheet is bent in the opposite direction as the direction in which the curl was formed, as shown in the central area of FIG. 4, the separation phenomenon will occur as illustrated in the right side of FIG. 4.

In other words, it is particularly likely for the separation phenomenon to occur if the sticker sheet is stretched upon a transport roller R for a long period of time within the high-temperature main unit 1' with one of those surfaces of the sticker sheet (the separator or the recording paper) making contact with the transport roller R, and the sticker sheet is then stretched upon a transport roller from the opposite direction so that the other surface of the sticker sheet is brought into contact with a transport roller R. To rephrase, it is particularly likely for the separation phenomenon to occur in areas within the main unit 1' of the printer 1 where transport rollers that make contact with opposite surfaces of the sticker sheet in an alternating manner are sequentially provided within the transport path. Note that the "transport rollers provided sequentially within the transport path" refers to the transport rollers upon which a certain portion of the sticker sheet is stretched in sequence.

If the separation phenomenon occurs in the sticker sheet in this manner, the sticker sheet will be defective as a product. Furthermore, the sticker sheet that is positioned in the printing region is sucked and held onto the platen 51 from the separator side. Accordingly, if the separation phenomenon has occurred in the sticker sheet that is positioned in the printing region (in other words, if the separation phenomenon has occurred in the sticker sheet upstream from the printing region in the transport path), part of the recording paper will be raised upward (that is, toward the head 42) from the separator, as illustrated in the right side of FIG. 4. Normally, the gap between the nozzle surface of the head 42 and the medium is set to a narrow gap. Accordingly, the raised portion of the recording paper will come into contact with the head 42. If this occurs, the recording paper will be soiled by the nozzle surface of the head 42, the head 42 will be damaged, or the like. Furthermore, if a raised portion is produced in the recording paper, the ink droplets ejected from the head 42 will not land in their proper positions, which in turn will lead to a drop in the quality of the printed image.

Accordingly, this embodiment aims to prevent the occurrence of the separation phenomenon in the sticker sheet.

Humidifying Unit 70

Figure 5A:
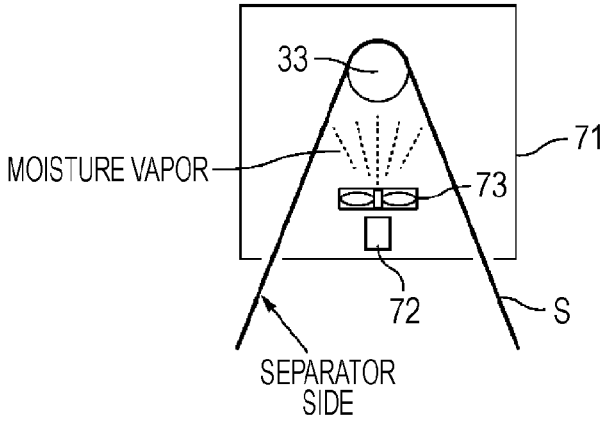
FIG. 5A and FIG. 5B are diagrams illustrating a humidifying unit.
Figure 5B:
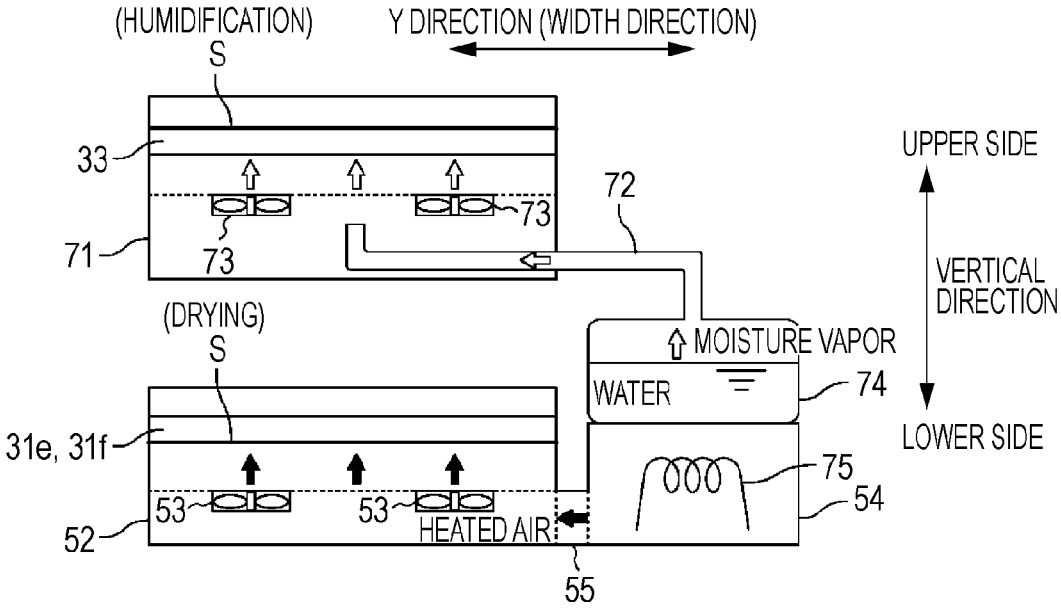

FIG. 5A and FIG. 5B are diagrams illustrating the humidifying unit 70. FIG. 5A is a general cross-sectional view illustrating the humidification of a sticker sheet S (the roll paper S), whereas FIG. 5B is a general side view illustrating the printer 1 from the side (that is, a diagram viewing the printer 1 from the X direction shown in FIG. 2). Note that in FIG. 5B, part of the sticker sheet S is illustrated by a bold line.

With the printer 1 according to this embodiment, the humidifying unit 70 (the humidifying unit) that humidifies the sticker sheet S is provided within the main unit 1' in which the high-temperature platen 51 and the drying chamber 52 are provided, in order to prevent the separation phenomenon illustrated in FIG. 4 from occurring. By doing so, even if the moisture in the sticker sheet S has evaporated within the high-temperature main unit 1', the sticker sheet S is humidified by the humidifying unit 70, which makes it possible to supplement the moisture content of the sticker sheet S.

This makes it possible to prevent the sticker sheet S from drying out while the sticker sheet S is present within the high-temperature main unit 1', which in turn makes it possible to prevent a drop in the adhesive strength of the adhesive. As a result, it is possible to prevent the occurrence of the separation phenomenon.

In addition, the sticker sheet S can be prevented from drying out even if the same portions of the sticker sheet S continue to be stretched upon the transport rollers, which makes it possible to prevent curls from being produced in the sticker sheet S by the transport rollers. As a result, it is possible to prevent the separation phenomenon from occurring even if the inner side of the separator is caused to curve, the sticker sheet S is caused to curve in the opposite direction with the recording paper on the inside, or the like when transporting the sticker sheet S.

In this embodiment, the humidifying unit 70 humidifies the sticker sheet S using a steam technique. Accordingly, as shown in FIG. 5B, the humidifying unit 70 includes the humidifying partition 71, a humidifying pipe 72, fans 73, a tank 74 that contains water, and a heater 75. Water vapor is produced when the water within the tank 74 is heated by the heater 75. The produced water vapor passes through the humidifying pipe 72 due to the fans 73 and disperses throughout the interior of the humidifying partition 71. As a result, the humidity of the air within the humidifying partition 71 becomes greater than the humidity of the air within the main unit 1' (that is, the humidity of the air outside of the humidifying partition 71). Accordingly, the sticker sheet S supplied to the humidifying partition 71 is humidified.

Note that it is preferable to sheathe the humidifying pipe 72 in an insulating material in order to prevent the water vapor in the humidifying pipe 72 from turning back into liquid (condensing). In addition, in this embodiment, the air within the humidifying partition 71 is constantly humidified when the platen 51, the drying chamber 52, and so on are being heated. Furthermore, the water within the tank 74 may be periodically filled by a user, or may be supplied automatically.

Meanwhile, it is possible to humidify the sticker sheet S and prevent the occurrence of the separation phenomenon even if the configuration is such that the air within the entire main unit 1' is humidified, rather than simply humidifying the air surrounded by the humidifying partition 71. In other words, the humidifying partition 71 need not be provided. However, a large number of metal components, electrical components, and so on are present within the main unit 1'. Accordingly, it is preferable to provide the humidifying partition 71 and humidify only the air within the humidifying partition 71, as is the case in this embodiment. By doing so, the humidity of the air within the main unit 1' can be prevented from becoming too high, which in turn makes it possible to prevent the metal components from rusting, water droplets from entering into the electrical components, and so on.

Meanwhile, it is preferable to humidify the sticker sheet S prior to printing. With the printer 1 according to this embodiment, the fixed roller 33 that is positioned upstream from the printing region in the transport path is surrounded by the humidifying partition 71, as shown in FIG. 2. Accordingly, the portion of the sticker sheet S that is stretched upon the fixed roller 33, and the portions in the vicinity thereof, are humidified. In other words, the sticker sheet S is humidified prior to printing. By doing so, it is possible to prevent the recording paper from rising up from the sticker sheet S upon the platen 51 as illustrated in the right side of FIG. 4, which in turn makes it possible to prevent the head 42 and the sticker sheet S from coming into contact, the landing positions of the ink droplets from shifting, and so on.

Furthermore, as described earlier, it is particularly likely for the separation phenomenon to occur in areas within the main unit 1' of the printer 1 where transport rollers that make contact with opposite surfaces of the sticker sheet S are sequentially provided in an alternating manner within the transport path. Accordingly, in this embodiment, the portion of the sticker sheet S that is stretched upon one of two transport rollers that are provided sequentially in the transport path and that make contact with different surfaces of the sticker sheet S is humidified by the humidifying unit 70.

By doing so, in the case where, for example, the portion of the sticker sheet S that is stretched upon the first transport roller is humidified, curls can be prevented from being formed in the portion of the sticker sheet S that continues to be stretched upon that first transport roller. Accordingly, the separation phenomenon can be prevented from occurring even if the sticker sheet S is bent in the opposite direction by the following transport roller.

On the other hand, in the case where the portion of the sticker sheet S that is stretched upon the following transport roller is humidified, the sticker sheet S is humidified when the sticker sheet S is stretched upon the following transport roller even if a curl has been formed in the portion of the sticker sheet S that has continued to be stretched upon the first transport roller. Accordingly, the recording paper, the separator, and so on are softened and the curl that was formed in the sticker sheet S is reduced, which makes it possible to prevent the separation phenomenon from occurring.

For example, as shown in FIG. 2, with the printer 1 according to this embodiment, in the area where the two mobile rollers 32 and the fixed roller 33 are provided sequentially in the transport path, the surface of the medium that makes contact with the first mobile roller 32*a* (that is, the recording paper), the surface of the medium that makes contact with the fixed roller 33 (that is, the separator), and the surface of the medium that makes contact with the second mobile roller 32*b* (that is, the recording paper), alternate. Accordingly, the humidifying unit 70 according to this embodiment humidifies the portion of the sticker sheet S that is stretched upon the fixed roller 33. By doing so, even if the sticker sheet S is alternately bent in opposite directions when passing over the two mobile rollers 32 and the fixed roller 33, the separation phenomenon can be prevented from occurring.

Furthermore, it is preferable for the humidifying unit 70 to humidify the portion of the sticker sheet S that is stretched upon the second transport roller from the upstream side in the transport path among the three transport rollers that are provided sequentially in the transport path and that make contact with different surfaces of the sticker sheet S in an alternating manner. In this embodiment, the portion of the sticker sheet S that is stretched upon the fixed roller 33, which, of the two mobile rollers 32 and the fixed roller 33, is the second roller from the upstream side, is humidified.

By doing so, even if a curl has been formed in the portion of the sticker sheet S that was stretched upon the first mobile roller 32*a*, which is the first roller from the upstream side, that portion is humidified upon being stretched upon the next roller, which is the fixed roller 33, and the curl is reduced as a result; this makes it possible to prevent the separation phenomenon from occurring. Furthermore, because the portion of the sticker sheet S that is stretched up on the fixed roller 33 is humidified, no curls are produced therein, which makes it possible to prevent the separation phenomenon from occurring. Further still, because the portion of the sticker sheet S that is stretched upon the second mobile roller 32*b*, which is the third roller, is also humidified immediately prior thereto, the separation phenomenon can be prevented from occurring.

In other words, humidifying the portion of the sticker sheet S that is stretched upon the central transport roller from among the three transport rollers that are provided sequentially makes it possible to prevent the separation phenomenon from occurring across the portions of the sticker sheet S that are stretched upon the respective three transport rollers.

In addition, it is preferable to humidify the portion of the sticker sheet S that is stretched upon the fixed roller 33, rather than the mobile rollers 32, as is the case with the humidifying unit 70 in this embodiment. If the portions of the sticker sheet S that are stretched upon the mobile rollers 32 are to be humidified, it becomes necessary to employ a configuration in which humidifying partitions that surround the mobile rollers 32 move along with the movement of the mobile rollers 32, or the existing humidifying partition is enlarged to accommodate the range of movement of the mobile rollers 32, which complicates the configuration. Meanwhile, in the case where a large space is provided in the humidifying partition in order to enable the mobile rollers 32 to enter into and exit from the humidifying partition, it becomes easier for water vapor to escape into the main unit 1', which in turn makes it difficult to humidify the air within the humidifying partition with certainty. Accordingly, humidifying the portion of the sticker sheet S that is stretched upon the fixed roller 33 makes it possible to simplify the configuration of the humidifying unit 70, and makes it possible to humidify the air within the humidifying partition 71 with certainty.

In addition, it is preferable for the humidifying unit 70 to humidify the sticker sheet S from the separator side (the separating base material side) of the sticker sheet S. For example, in the case where the humidifying unit 70 carries out humidification using a steam technique, as in this embodiment, water vapor is blown against the separator. Accordingly, in this embodiment, the opening in the humidifying pipe 72 that blows the water vapor is opposed to the separator, as shown in FIG. 5A.

With recording paper, which absorbs water-based inks, there is a limit to the moisture absorption capability of the recording paper, and there are cases, depending on the type of the recording paper, where the moisture absorption capability is low. Accordingly, in the case where recording paper having a low moisture absorption capability is used, it is particularly favorable to humidify the sticker sheet S from the separator side. By doing so, the recording paper can be prevented from being excessively humidified. As a result, it is possible to prevent an amount of ink that exceeds the moisture absorption capability of the recording paper from being ejected, prevent the ink in the printed image from bleeding, and in turn prevent the quality of the printed image from dropping. However, even if the humidification is carried out from the separator side, it should be noted that the humidity of the air within the humidifying partition 71 is high, and thus the recording paper is also humidified in addition to the separator.

In addition, the humidifying unit 70 according to this embodiment produces water vapor by heating water and humidifies the sticker sheet S using that water vapor; furthermore, the same heat source that is used by the drying chamber 52 (the heating unit) that fixes the images onto the sticker sheet S is used by the humidifying unit 70 to heat the water. Doing so makes it possible to reduce costs by reducing the number of components of the printer 1, and also makes it possible to reduce energy consumption.

Accordingly, in this embodiment, the heater 75 (that is, a heat source) that heats the water within the tank 74 is provided within a housing 54, as shown in FIG. 5B. The air within the housing 54 is heated by the heater 75, and is therefore at a high temperature. Here, fans 53 within the drying chamber 52 suck the heated air in the housing 54 into the drying chamber 52 via an air channel 55 that connects the drying chamber 52 and the housing 54. As a result, the air within the drying chamber 52 can be set to a high temperature, which makes it possible to fix the images printed onto the sticker sheet S supplied to the drying chamber 52 onto the sticker sheet S. It should be noted that in this embodiment, the configuration is such that the heated air sucked by the fans 53 is blown onto the printing surface of the sticker sheet S, and thus the printed images can be fixed onto the sticker sheet S with more certainty.

Furthermore, by providing the humidifying unit 70 in the printer 1 and humidifying the sticker sheet S, it is possible not only to prevent the occurrence of the separation phenomenon, but also to prevent the sticker sheet S from shrinking, for example, on the high-temperature platen 51. As a result, it is possible to prevent curls, wrinkles, and so on from being produced in the sticker sheet S upon the platen 51, which in turn makes it possible to prevent the landing positions of dots from shifting and so on.

In this embodiment, the humidifying unit 70 humidifies the sticker sheet S using a steam technique; however, the technique is not limited thereto. For example, the sticker sheet S may be humidified by blowing misted water against the sticker sheet S, or may be humidified using a vaporization technique, an ultrasound wave technique, or the like.

Variations

In the aforementioned embodiment, the sticker sheet S within the humidifying partition 71 is constantly humidified when the platen 51, the drying chamber 52, and so on are heated. However, the separation phenomenon is more likely to occur the longer the same portion of the sticker sheet S remains within the high-temperature main unit 1', such as when maintenance operations are being carried out.

Accordingly, the humidifying unit 70 may humidify the sticker sheet S in the case where a predetermined amount of time has passed after the transport of the sticker sheet S by the transport unit 30 has stopped (in other words, before the separation phenomenon begins to occur). To implement this, for example, the controller 10 may count the amount of time that has passed since the transport stopped using a timer, and may then cause the humidifying unit 70 to operate in the case where the predetermined amount of time has passed.

Doing so makes it possible to suppress the humidifying unit 70 from excessively humidifying the sticker sheet S while also preventing the separation phenomenon with certainty. Meanwhile, suppressing the humidifying unit 70 from excessively humidifying the sticker sheet S makes it possible, for example, to reduce the amount of power consumed, reduce the number of times the water in the tank 74 needs to be refilled, and so on. In addition, it is also possible to prevent media having low moisture absorption capabilities from being excessively humidified and the printed image from bleeding as a result.

In addition, an air humidity indicator may be provided within the main unit 1' of the printer 1, and the humidifying unit 70 may then humidify the sticker sheet S in the case where the humidity of the air within the main unit 1' has dropped below a predetermined humidity (in other words, before the humidity drops below a humidity at which the separation phenomenon begins to occur). Furthermore, the moisture content of the sticker sheet positioned within the main unit 1' may be measured, and the humidifying unit 70 may humidify the sticker sheet S in the case where the moisture content of the sticker sheet has dropped below a predetermined amount (in other words, before the moisture content has dropped below a point where the separation phenomenon begins to occur).

Meanwhile, although the fixed roller 33 is surrounded by the humidifying partition 71 and the portion of the sticker sheet S that is stretched upon the fixed roller 33 is humidified along with the portions of the sticker sheet S that are in the vicinity thereof in the aforementioned embodiment, the invention is not limited thereto. The separation phenomenon can be prevented from occurring even in the case where other portions of the sticker sheet S are humidified.

In addition, although the humidifying unit 70 in the aforementioned embodiment humidifies the portion of the sticker sheet S that is stretched upon the second transport roller from the upstream side in the transport path (that is, the fixed roller 33) among the three transport rollers that are provided sequentially in the transport path and that make contact with different surfaces of the sticker sheet S in an alternating manner, the invention is not limited thereto. For example, the portion of the sticker sheet S that is stretched upon the first transport roller from the upstream side in the transport path (that is, the first mobile roller 32*a*) may be humidified.

Even in such a case, sufficiently humidifying the sticker sheet S makes it possible to prevent curls from being formed even in the portion of the sticker sheet S that is stretched upon the second roller, which is the fixed roller 33, and the portion of the sticker sheet S that is stretched upon the third roller, which is the second mobile roller 32*b*. As a result, it is possible to prevent the occurrence of the separation phenomenon.

Other Embodiments

Although the aforementioned embodiment has primarily described an image recording apparatus, an image recording method and so on also falls within the scope of this disclosure. Furthermore, the aforementioned embodiment is provided to facilitate understanding of the invention and is not to be interpreted as limiting the invention in any way. It goes without saying that many variations and modifications can be made without departing from the essential spirit of the invention, and thus equivalents of all such variations and modifications also fall within the scope of the invention. In particular, the embodiments described hereinafter also fall within the scope of the invention.

Printer

Although the aforementioned embodiment describes, as an example, the printer 1 that prints images onto roll paper positioned in the printing region while moving the head 42 in the X direction and the Y direction, the invention is not limited thereto. For example, the printer may be a printer that prints images while roll paper passes below a fixed head 42. Furthermore, the medium onto which images are recorded is not limited to roll paper, and may instead be single sheets of paper; and the image recording apparatus may be an apparatus which records images onto a medium by ejecting a fluid aside from ink through the nozzles.

In addition, the image recording apparatus is not limited to a printer; the same techniques as those described in the aforementioned embodiment may be applied to various types of apparatuses that employ ink jet techniques, such as color filter manufacturing apparatuses, dyeing apparatuses, microfabrication apparatuses, semiconductor manufacturing apparatuses, surfacing apparatuses, three-dimensional molding machines, liquid vaporizing apparatuses, organic EL manufacturing apparatuses (and in particular, high-polymer EL manufacturing apparatuses), display manufacturing apparatuses, deposition apparatuses, DNA chip manufacturing apparatuses, and so on. The methods used thereby and manufacturing methods thereof also fall within the scope of application of the invention.

What is claimed is:

1. An image recording apparatus comprising:

a transport unit that transports, along a transport path, a medium including a recording base material whose one surface is a recording layer for an image and whose other surface is an adhesive layer and a separating base material that covers the adhesive layer;

a recording unit that records an image onto the medium;

a heating unit that fixes the recorded image onto the medium; and a humidifying unit that increases the moisture of the medium.

2. The image recording apparatus according to claim 1, wherein the transport unit transports the medium using a plurality of transport rollers; and the humidifying unit humidifies the portion of the medium that is stretched upon one of two of the transport rollers that are provided sequentially in the transport path and that make contact with different surfaces of the medium.

3. The image recording apparatus according to claim 2, wherein the humidifying unit humidifies the portion of the medium that is stretched upon the second transport roller from the upstream side in the transport path among three of the transport rollers that are provided sequentially in the transport path and that make contact with different surfaces of the medium in an alternating manner.

4. The image recording apparatus according to claim 1, wherein the humidifying unit humidifies the medium from the separating base material side.

5. The image recording apparatus according to claim 1, wherein the humidifying unit produces water vapor by heating water and humidifies the medium using the water vapor; and the same heat source is used as a heat source for the heating unit and a heat source used by the humidifying unit to heat the water.

6. The image recording apparatus according to claim 1, wherein the humidifying unit humidifies the medium in the case where a predetermined amount of time has passed after the transport unit has stopped transporting the medium.

7. An image recording method for recording an image onto a medium using an image recording apparatus, the apparatus including:

a transport unit that transports, along a transport path, a medium including a recording base material whose one surface is a recording layer for an image and whose other surface is an adhesive layer and a separating base material that covers the adhesive layer;

a recording unit that records an image onto the medium;

a heating unit that fixes the recorded image onto the medium; and a humidifying unit that increases the moisture of the medium.

* * * * *